United States Patent [19]

Tomaszewski

[11] Patent Number: 5,013,049

[45] Date of Patent: May 7, 1991

[54] CARD GAME

[76] Inventor: Joseph Tomaszewski, 2020 Palma Vista, Las Vegas, Nev. 89109

[21] Appl. No.: 523,318

[22] Filed: May 14, 1990

[51] Int. Cl.[5] ..... A63F 1/00

[52] U.S. Cl. ..... 273/292

[58] Field of Search ..... 273/292

[56] References Cited

U.S. PATENT DOCUMENTS

| | | | |
|---|---|---|---|
| 4,643,431 | 2/1987 | Hilinsky | 273/243 |
| 4,659,087 | 4/1987 | Shen et al. | 273/274 |
| 4,836,553 | 6/1989 | Suttle et al. | 273/292 |
| 4,861,041 | 8/1989 | Jones et al. | 273/292 |

*Primary Examiner*—William H. Grieb

*Attorney, Agent, or Firm*—Quirk, Tratos & Roethel

[57] ABSTRACT

A deck of 54 cards is used comprising a standard deck of 52 playing cards plus two Jokers. Each Joker has a numerical value of 7 and has no suit value. The Face Cards and 10's count zero, the Aces count 1 and all other cards have their face value. A player and a dealer each receive a hand of five cards. The player may discard and draw up to two cards. The dealer must discard and draw based on preestablished criteria. Between the player and the dealer, whoever has a three card combination closest to the numerical value of 21 without going over wins the hand. If the player and the dealer each achieve the same numerical value other than 21, the hand is a push.

If the player and the dealer each achieve 21, this tie may be broken based on the following hand ranking criterion:

Rank #1. 6-7-8 of the same suit

Rank #2. Flush 21 (three cards of the same suite totalling 21)

Rank #3. Three 7's

Rank #4. Pair 21 (three cards totalling 21: two 6's and a 9, two 8's and a 5 or two 9's and a 3)

Rank #5. Other 21 combinations.

If the tie is with the same Rank #, the hand is a push. If the player has Three 7's (Rank #3), and the dealer has a Rank #1 or Rank #2 hand, then the hand is a push.

17 Claims, 3 Drawing Sheets

CARD GAME

This invention relates to a card game, and more particularly to a variation of the games of Twenty-One and Draw Poker in which the player may draw cards in an attempt to improve his hand.

BACKGROUND OF THE INVENTION

Twenty-One is a well known game in which the player and the dealer compete in an attempt to come closest, without going over, the total numerical value of 21. Using a 52 card deck of standard playing cards, the dealer deals alternately two cards to both the player and himself. The value of the cards is determined by their numerical value, with Aces counting 1 or 11 and Kings, Queens and Jacks ("Face Cards") counting 10. The player may receive additional cards ("hits") from the dealer in an attempt to obtain a hand having a value of 21. The player may stop receiving cards at any time, but if the player's hand has a value in excess of 21 the player automatically loses ("busts"). The dealer then is dealt additional cards until the value of the dealer's hand is at least 17. Whoever between the player and the dealer has the closest to 21 without going over wins the hand. If the player and the dealer end up with the same numerical value, a tie hand ("push") results.

In the casino version of Twenty-One, a winning player receives one-to-one odds on the amount of his bet. In the event of a push, the player retains his bet. If the player's first two cards total 21 (an Ace and a Face Card or 10), the player typically receives 3-to-2 odds on his bet (unless the hand is a push). Other variations to Twenty-One are also well known, such a doubling down, splitting pairs and taking insurance. In conventional Twenty-One, the various suits (Spades, Hearts, Diamonds and Clubs) have no significance.

Poker is also a well known game utilizing a standard deck of playing cards. Poker is played in a myriad of variations such as Draw Poker and Stud Poker. In Poker, various combinations of cards have significance, based on both the numerical value of the cards and the suits. The basic object of Poker is for the player to achieve a five card hand having a higher Poker rank than the hands held by the player's opponents. The basic priority or rank order of winning poker hands is: Royal Flush, Straight Flush, Four of a Kind, Full House, Flush, Straight, Three of a Kind, Two Pair, One Pair and High Card(s) in Hand.

It is also been known to utilize wild cards in the game of Poker. Typically one or more types of cards from the standard playing deck are designated as wild cards, such as deuces or one-eyed Jacks. It is also known to add an extra card or cards to the deck as wild cards and these extra cards are conventionally referred to as Jokers.

It is an object of the present invention to design a new card game that combines the best features of Twenty-One and Poker.

It is a feature of the present invention to utilize a standard deck of playing cards with two extra Joker cards and to designate a new ranking criterion based on combinations of three card hands.

It is an advantage of the present invention that a new and exciting, yet easy to learn, card game has been created combining the best features of Twenty-One and Poker.

SUMMARY OF THE INVENTION

A deck of 54 cards is used comprising a standard deck of 52 playing cards plus two Jokers. Each Joker has a numerical value of 7 and has no suit value. The Face Cards and 10's count zero, the Aces count 1 and all other cards have their face value. A player and a dealer each receive a hand of five cards. The player may discard and draw up to two cards. The dealer must discard and draw based on preestablished criteria. Between the player and the dealer, whoever has a three card combination closest to the numerical value of 21 without going over wins the hand. If the player and the dealer each achieve the same numerical value other than 21, the hand is a push.

If the player and the dealer each achieve 21, this tie may be broken based on the following hand ranking criterion:

Rank #1. 6-7-8 of the same suit

Rank #2. Flush 21 (three cards of the same suit totaling 21)

Rank #3. Three 7's

Rank #4. Pair 21 (three cards totaling 21: two 6's and a 9, two 8's and a 5 or two 9's and a 3)

Rank #5. Other 21 combinations.

If the tie is with the same Rank #, the hand is a push. If the player has Three 7's (Rank #3), and the dealer has a Rank #1 or Rank #2 hand, then the hand is a push.

DETAILED DESCRIPTION OF THE PREFERRED EMBODIMENTS

The invention involves a new card game that combines the best features of Twenty-One and Draw Poker. The game uses a deck of 54 cards comprising a standard deck of 52 playing cards plus two Jokers. Except for the Jokers, the cards have the conventional suit designations—Spades, Hearts, Diamonds and Clubs.

Each card is given a numerical value that is used during the game. Each Joker has a numerical value of 7 and has no suit value. The Face Cards and 10's count zero, the Aces count 1 and all other cards have their normal face value between 2 and 9.

Figure 1:
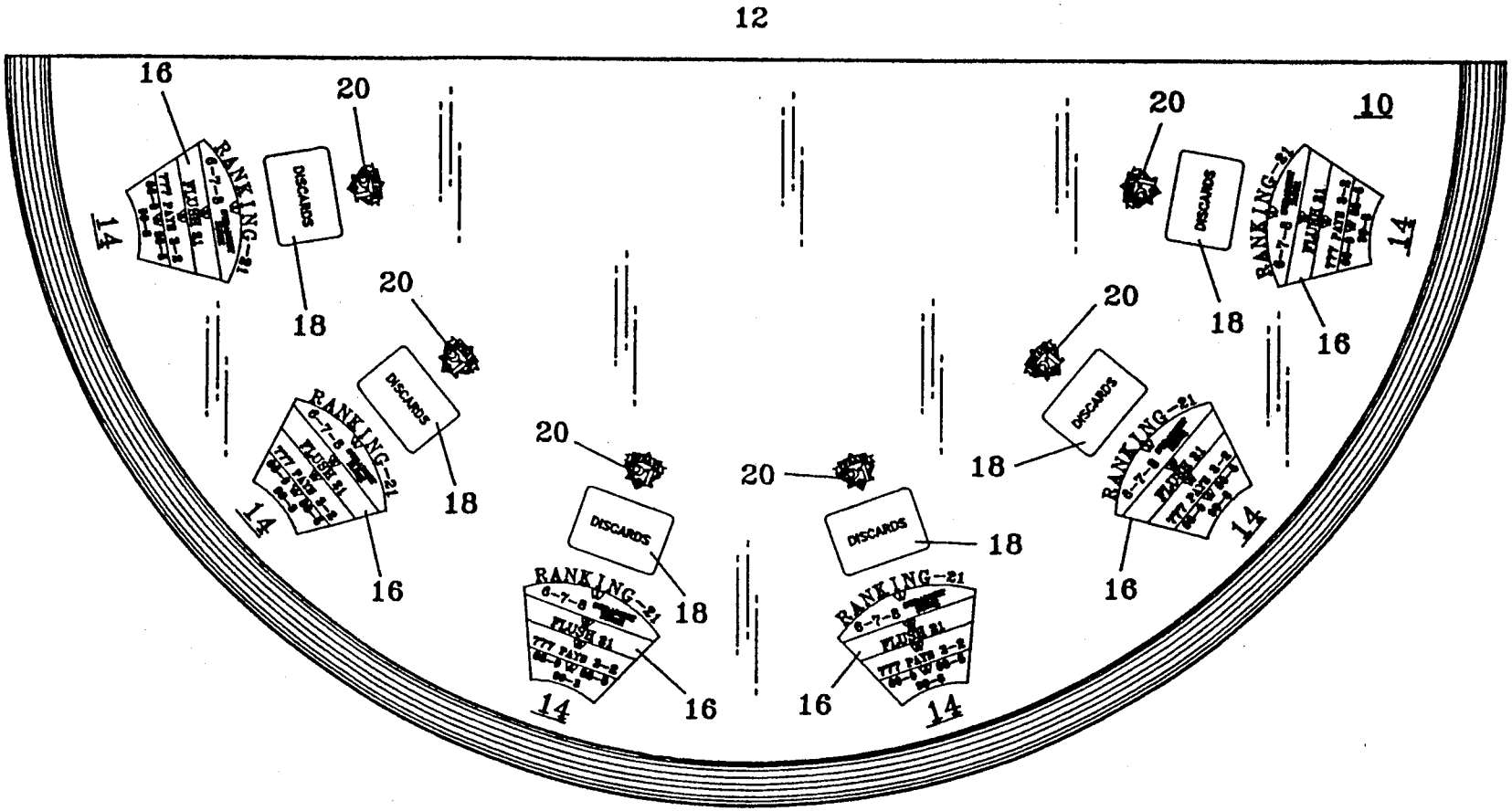
FIG. 1 shows a casino table layout for the card game of the present invention.

In the casino version of the game, a table layout 10 is provided as shown in FIG. 1. As in the casino version of Twenty-One, a dealer is stationed at the conventional dealer location 12 from which the dealer can deal cards to the player and himself and perform the other functions done by the dealer such as paying winning wagers and collecting losing wagers.

Up to six player locations 14 (although the number can be more or less as desired) are provided around the perimeter of the table layout 10. Each player location includes a block 16 in which the hand rankings are set out, a block 18 in which the, player may place his discards and a location 20 at which the player may place his wager.

Even though FIG. 1 shows up to six player locations 14, the game is played by each player individually against the dealer. That is, as in Twenty-One, the players do not play against each other but only against the dealer.

The players and the dealer each receive a hand of five cards dealt by the dealer. In the preferred embodiment, the dealer deals one card to each of the players and then one card to himself until all players and the dealer have five cards, although other methods of dealing may be employed. In the preferred embodiment, the dealer does not look at his hand until each player has completed discarding and drawing new cards as will be explained.

The basic object of the game is for the player to achieve a hand that has a numerical value of 21 based on the total numerical value of three of the cards out of the five cards in the player's hand. In order to assist the player in achieving this total of 21, the player may discard and draw up to two cards. The player places his discards, preferably face down, in the discard block 18 and the dealer deals the player additional cards equal to the number of cards which the player discards, much in the manner that Draw Poker is played.

After the player has received his new cards, the player selects those three cards out of his remaining five that have a total numerical value closest to, without going over, 21. The player places his three cards face up on the table layout in block 16 and discards his remaining two cards face down in the discard block 18.

After each player has discarded and received new cards, the dealer must discard and draw based on preestablished criteria. The dealer must keep the highest three cards of numerical value (regardless of suit) and the dealer must draw two cards.

Between each player and the dealer, whoever has a three card combination closest to the numerical value of 21 without going over wins the hand. If the player and the dealer each achieve the same numerical value other than 21, the hand is a push.

If the player and the dealer each achieve 21, this tie may be broken based on the following hand ranking criterion:

Rank #1. 6-7-8 of the same suit

Rank #2. Flush 21 (three cards of the same suit totaling 21)

Rank #3. Three 7's

Rank #4. Pair 21 (three cards totaling 21: two 6's and a 9, two 8's and a 5 or two 9's and a 3)

Rank #5. Other 21 combinations.

If the tie is with the same Rank #, the hand is a push. If the player has Three 7's (Rank #3), and the dealer has a Rank #1 or Rank #2 hand, then the hand is a push.

In the casino version of the game, if wagering is in effect, the player receives one-to-one odds on his bet if the player has the winning hand. If the player wins the hand with three 7's, the player is paid three-to-two odds on the amount of his bet. Of course, other odds may be used but these are the preferred embodiment. Additionally, the house may also collect a 5% rake or vigorish on the amount of the player's initial bet if the player has a winning hand as is the practice in other casino games such as Baccarat.

In the preferred embodiment, all discards are kept face down so that the other players at the table do not obtain an unfair advantage over the players would must draw first. At the end of each hand, the dealer collects all of the cards and reshuffles for the next hand.

Figure 2:
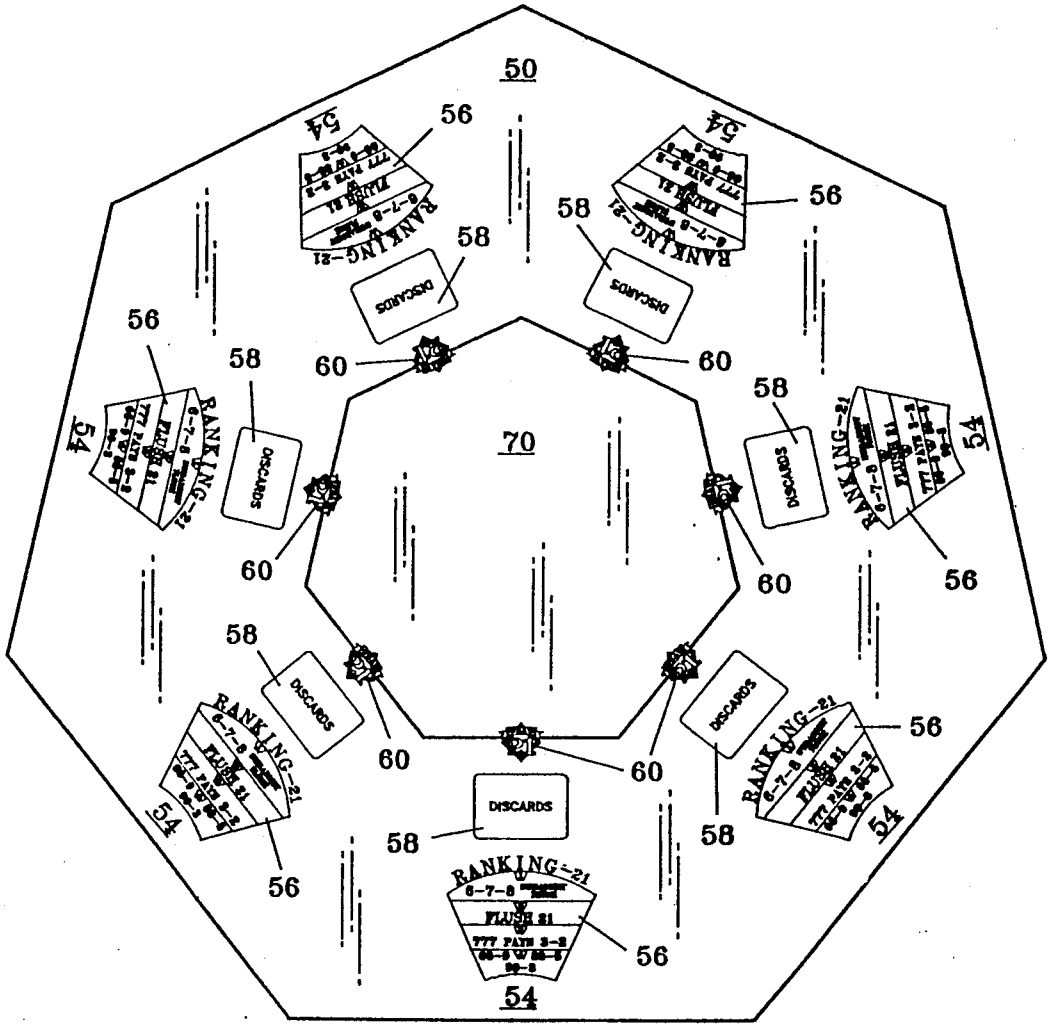
FIG. 2 shows a board game layout for the card game of the present invention.
Figure 3:
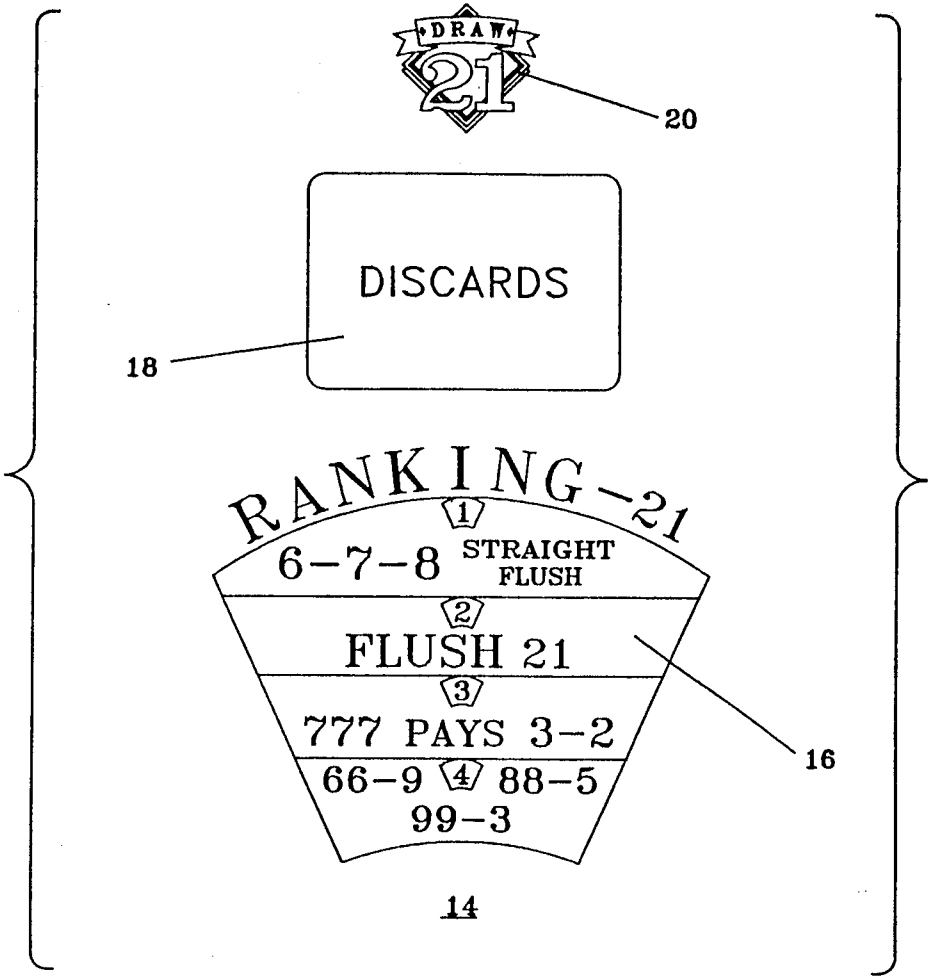
FIG. 3 shows an enlarged view of an individual player location for the card game of the present invention.

FIG. 2 shows a board game layout for the card game of the present invention. A table layout 50 is provided as shown in FIG. 2. Unlike the casino version of the game however, there is no house dealer in the board game version, but rather the deal passes from one player to the next player at the end of each hand. The initial dealer can be selected in any conventional manner, such as cutting the cards, and then the deal can rotate clockwise around the table.

Up to seven player locations 54 are provided around the perimeter of the table layout 50. Each player location includes a block 56 in which the hand rankings are set out, a block 58 in which the player may place his discards and a location 60 at which the player may place his wager.

The procedures of the board game version of the game are essentially the same as the procedures described above for the casino version, except that there is no house that pays or collects winning or losing wagers, respectively. The player who acts as the dealer for each particular hand performs the functions of the dealer and pays or collects all wagers from his own account. In the preferred embodiment, the 5% rake or vigorish, instead of going to the house or the dealer is placed in the center 70 of the table as a jackpot. The jackpot is won by the player who achieves a preidentified hand, such as three 7's.

Alternatively to playing either version of the game as a wagering game, the game may be player simply as an amusement activity with the player achieving the most play money at the end of the designated time period being declared the winner.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

(a) providing a deck of 54 cards comprising a standard 52 card deck of playing cards with two additional Jokers, (b) establishing values for each card, the values being: Ace - 1, King - 0, Queen - 0, Jack - 0, Joker - 7 with no suit designation and all other cards keeping their face value, (c) dealing five cards to a player and a dealer, (d) the player and dealer each discarding and drawing up to two cards, (e) the player and dealer each selecting the three of his five cards that numerically add up closest to, without going over, a total of 21, (f) comparing the numerical value of the player's hand to the dealer's hand with the highest hand winning, (g) in the event of a numerically tied hand, further comparing the hands according to a predetermined criteria to attempt to establish a winner.

2. The method of claim 1 wherein the predetermined criteria is:

(a) if the numerically tied hands have a value other than 21, the hand remains a tie, (b) if the numerically tied hands have a value of 21, the winner is determined by the following ranking:

Rank #1. 6-7-8 of the same suit

Rank #2. Flush 21 (three cards of the same suit totaling 21)

Rank #3. Three 7's

Rank #4. Pair 21 (three cards totaling 21: two 6's and a 9, two 8's and a 5 or two 9's and a 3)

Rank #5. Other 21 combinations, (c) if the player and the dealer each have a hand of the same Rank #, the hand remains a tie.

3. The method of claim 2 wherein the predetermined criteria further includes if the player has a hand of Rank #3 and the dealer has a hand of Rank #1, Rank #2 or Rank #3, then the hand remains a tie.

4. The method of claim 1 wherein the dealer draws and discards based on a preestablished criteria.

5. The method of claim 4 wherein the preestablished criteria is the dealer keeps the three cards having the highest numerical value and draws two cards.

6. A method of playing a card game comprising:

(a) providing a deck of 54 cards comprising a standard 52 card deck of playing cards with two additional Jokers, (b) establishing values for each card, the values being: Ace - 1, King - 0, Queen - 0, Jack - 0, Joker - 7 with no suit designation and all other cards keeping their face value, (c) the player wagering an amount to be eligible to participate in the game, (d) dealing five cards to a player and a dealer, (e) the player and dealer each discarding and drawing up to two cards, (f) the player and dealer each selecting the three of his five cards that numerically add up closest to, without going over, a total of 21, (g) comparing the numerical value of the player's hand to the dealer's hand with the highest hand winning, (h) in the event of a numerically tied hand, further comparing the hands according to a predetermined criteria to attempt to establish a winner, (i) if the player has the winning hand, the player winning a designated amount based on the particular combinations of cards in the player's hand.

7. The method of claim 6 wherein the predetermined criteria is:

(a) if the numerically tied hands have a value other than 21, the hand remains a tie, (b) if the numerically tied hands have a value of 21, the winner is determined by the following ranking:

Rank #1. 6-7-8 of the same suit

Rank #2. Flush 21 (three cards of the same suit totaling 21)

Rank #3. Three 7's

Rank #4. Pair 21 (three cards totaling 21: two 6's and a 9, two 8's and a 5 or two 9's and a 3)

Rank #5. Other 21 combinations, (c) if the player and the dealer each have a hand of the same Rank #, the hand remains a tie.

8. The method of claim 7 wherein the predetermined criteria further includes if the player has a hand of Rank #3 and the dealer has a hand of Rank #1, Rank #2 or Rank #3, then the hand remains a tie.

9. The method of claim 6 wherein the designated amount won by the player is 3-to-2 odds if the player's hand comprises three 7's and 1-to-1 odds on any other combination of cards in the player's hand.

10. The method of claim 6 wherein the dealer retains a percentage of the amount won by the player.

11. The method of claim 10 wherein the percentage is 5%.

12. The method of claim 6 wherein a percentage of the amount won by the player is placed in a jackpot to be won when a player achieves a preidentified hand.

13. The method of claim 12 wherein the preidentified hand is three 7's.

14. The method of claim 13 wherein the percentage is 5%.

15. The method of claim 12 wherein the percentage is 5%.

16. The method of claim 6 wherein the dealer draws and discards based on a preestablished criteria.

17. The method of claim 16 wherein the preestablished criteria is the dealer keeps the three cards having the highest numerical value and draws two cards.

* * * * *